US006407655B1

(12) United States Patent
Kitamura

(10) Patent No.: US 6,407,655 B1
(45) **Date of Patent: *Jun. 18, 2002**

(54) WOUND CORE FOR TOROIDAL TRANSFORMER

(75) Inventor: Fumio Kitamura, Chino (JP)

(73) Assignee: Kitamura Kiden Co., Ltd., Nagano (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/807,518

(22) Filed: Feb. 27, 1997

Related U.S. Application Data

(63) Continuation of application No. 08/395,824, filed on Feb. 28, 1995, now abandoned.

(30) Foreign Application Priority Data

Mar. 16, 1994 (JP) ..... 6-046017

(51) Int. Cl.[7] ..... H01F 27/24
(52) U.S. Cl. ..... 336/213; 336/234
(58) Field of Search ..... 336/229, 213, 336/234, 212

(56) References Cited

U.S. PATENT DOCUMENTS

| | | | | |
|---|---|---|---|---|
| 3,149,296 A | * | 9/1964 | Cox | 336/229 |
| 3,201,734 A | | 8/1965 | Halacsy | |
| 3,465,273 A | | 9/1969 | Brock | |
| 4,842,208 A | | 6/1989 | Kitamura | |
| 4,848,684 A | | 7/1989 | Sasaki et al. | 336/212 |
| 5,115,703 A | | 5/1992 | Kitamura | |
| 5,188,305 A | | 2/1993 | Kitamura | |
| 5,307,044 A | | 4/1994 | Watabe | 336/234 |

FOREIGN PATENT DOCUMENTS

| | | | | |
|---|---|---|---|---|
| DE | 32 32 025 | | 3/1984 | |
| DE | 36 03 473 | | 5/1987 | |
| EP | 0 010 427 | | 4/1980 | |
| EP | 0 269 347 | | 6/1988 | |
| EP | 0 362 035 | | 4/1990 | |
| EP | 0 586 246 | | 3/1994 | |
| FR | 1 107 583 | | 1/1956 | |
| FR | 2 642 566 | | 8/1990 | |
| JP | 39-13852 | * | 7/1964 | |
| JP | 52-58818 | | 5/1977 | 336/213 |
| JP | 53-84118 | | 7/1978 | |
| JP | 55-6812 | | 1/1980 | |
| JP | 55-34405 | | 3/1980 | |
| JP | 55-132027 | | 10/1980 | |
| JP | 56-80113 | | 1/1981 | |
| JP | 56-80113 | | 7/1981 | |
| JP | 60-003108 | | 1/1985 | |
| JP | 58-201568 | | 7/1985 | |
| JP | 60-3018 | | 9/1985 | |
| JP | 62-247511 | | 10/1987 | |
| JP | 63-132408 | | 4/1988 | |
| JP | 63-188916 | * | 8/1988 | |
| JP | 1206610 A | | 8/1989 | |
| JP | 1-206610 | * | 8/1989 | |
| JP | 2-89304 | | 3/1990 | |
| JP | 2-113509 | | 4/1990 | |
| JP | 5-41327 | | 2/1993 | |
| JP | 5-229277 | | 11/1993 | |
| WO | WO 83/02194 | | 6/1983 | |
| WO | WO 85/03379 | | 8/1985 | |

OTHER PUBLICATIONS

Copy of Japanese Patent Office Office Action for the corresponding Japanese patent application (No Date).*

* cited by examiner

*Primary Examiner*—Lincoln Donovan
(74) *Attorney, Agent, or Firm*—Merchant & Gould P.C.

(57) ABSTRACT

A wound core for a toroidal transformer has an improved shape, for example, circular or elliptic longitudinal ends in section, to properly attach a coil (toroidal winding) to the wound core. Therefore, the wound core allows a toroidal transformer that employs the wound core to achieve full performance, and improves the productivity of the toroidal transformers.

3 Claims, 10 Drawing Sheets

WOUND CORE FOR TOROIDAL TRANSFORMER

This is a Continuation of application Ser. No. 08/395,824, filed Feb. 28, 1995 now abandoned.

BACKGROUND OF THE INVENTION

1. Field of the Invention

The present invention relates to a wound core, and more particularly, to a wound core for a toroidal transformer.

2. Description of the Related Art

Recently, toroidal transformers employing toroidal windings, which are thin, light, and low in leakage flux, have often been used in audio equipment and in monitors of computer systems. It is required to provide wound cores that permit an improvement in the productivity of the toroidal transformers and allow the toroidal transformers to provide full performance.

A wound core is made by winding several hundred turns of a grain-oriented silicon steel strip, about 0.2 to 0.3 mm thick, around a cylindrical jig. In the prior art, the wound core has a rectangular section with long longitudinal sides and an annular plan shape. Further, the surface of the wound core is covered with an insulating film around which a copper wire such as an enameled wire is wound according to a toroidal winding technique, to form a transformer (toroidal transformer).

By the way, the ideal sectional shape of a core of a winding is circular. Many patent and utility model applications have disclosed wound cores having a circular section. For example, there are Japanese Patent Publication (Kokoku) Nos. 60-28375, 61-22851, and 5-29289 (corresponding to U.S. Pat. Nos. 5,115,703 and 5,188,305). Note that, these disclosures employ a cylindrical coil bobbin for winding a wire as nearly circular as possible.

The core for a toroidal transformer must be longitudinally elongated in section, to reduce the area occupied by the transformer. The diameter of the core must be short to reduce its weight. A core having a rectangular section produces a transformer which has a high ratio of iron and copper to its volume.

As described above, in the prior art, the section of the wound core for the toroidal transformer is rectangular, and copper wire is wound around the wound core according to a toroidal winding technique, to form the toroidal coil. Therefore, spaces are formed between the wound core and the toroidal coil.

The spaces between the wound core and the coil (toroidal coil) increase the size of the coil and increase the length of the copper wire, per turn, around the wound core, to increase the resistance of the coil. In addition, the spaces may cause noise and vibration.

SUMMARY OF THE INVENTION

An object of the present invention is to provide a wound core for a toroidal transformer that allows full performance and improves the productivity of toroidal transformers.

According to the present invention, there is provided a wound core for a toroidal transformer, having circular or elliptic longitudinal ends in section. Further, according to the present invention, there is provided a wound core for a toroidal transformer, having polygonal longitudinal ends in section. Further, according to the present invention, there is also provided a wound core for a toroidal transformer, having circular or elliptic starting part and ending part in section. In addition, according to the present invention, there is provided a wound core for a toroidal transformer, having polygonal starting part and ending part in section.

According to the present invention, there is provided a wound core for a toroidal transformer, having an elliptic section. Further, according to the present invention, there is provided a wound core for a toroidal transformer, having curved corners in section. Further, according to the present invention, there is also provided a wound core for a toroidal transformer, having beveled corners in section.

According to the present invention, there is provided a toroidal transformer comprising a wound core and a toroidal winding, wherein the wound core has circular or elliptic longitudinal ends in section. Further, according to the present invention, there is provided a toroidal transformer comprising a wound core and a toroidal winding, wherein the wound core has polygonal longitudinal ends in section. Further, according to the present invention, there is also provided a toroidal transformer comprising a wound core and a toroidal winding, wherein the wound core has circular or elliptic starting part and ending part in section. In addition, according to the present invention, there is provided a toroidal transformer comprising a wound core and a toroidal winding, wherein the wound core has polygonal starting part and ending part in section.

According to the present invention, there is provided a toroidal transformer comprising a wound core and a toroidal winding, wherein the wound core has an elliptic section. Further, according to the present invention, there is provided a toroidal transformer comprising a wound core and a toroidal winding, wherein the wound core has curved corners in section. Further, according to the present invention, there is also provided a toroidal transformer comprising a wound core and a toroidal winding, wherein the wound core has beveled corners in section.

The wound core may be manufactured by continuously cutting a material strip into shaped bands and by winding a unit length of the shaped bands around a jig. The jig may be cylindrical and be turned around its axis to wind a unit length of the shaped bands around the jig, to form the wound core.

A longitudinal center line of each of the shaped bands may be aligned with the widthwise center of the jig, and a unit length of the shaped bands may be wound around the jig. The material strip may be cut into the shaped bands with the maximum and minimum widths of a first band of the shaped bands being substantially adjacent to the minimum and maximum widths of a second band of the shaped bands.

The material strip may be cut into the shaped bands with a linear side-edge of the material strip serving, as it is, as a linear side-edge of one or two of the shaped bands. The material strip may be cut into two shaped bands with each linear side-edge of the material strip serving, as it is, as a linear side-edge of each of the shaped bands, and with narrowed and widened parts of a first band of the shaped bands being substantially adjacent to widened and narrowed parts of a second band of the shaped bands, so that a remainder of the material strip between the first and second shaped bands may be discarded.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

For a better understanding of the preferred embodiments, the problems of the related art will be explained, with reference to FIGS. 1A, 1B, and 2.

Figure 1A:
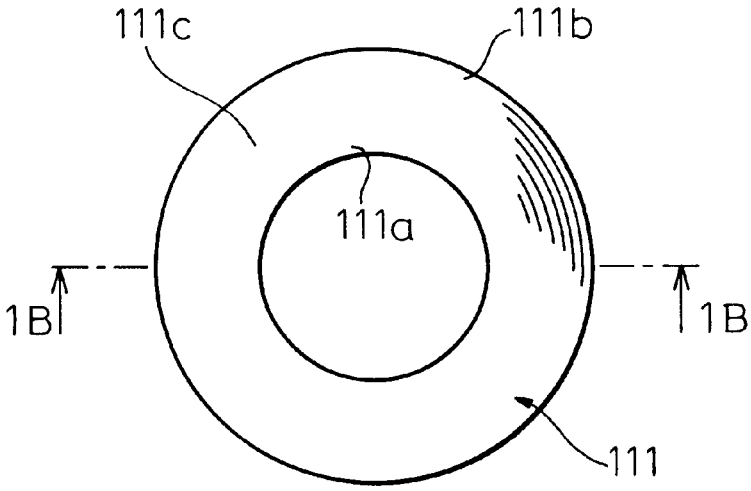
Fig.1A (PRIOR ART)
FIG. 1A is a plan diagram showing an example of a wound core for a toroidal transformer according to a prior art.
Figure 1B:
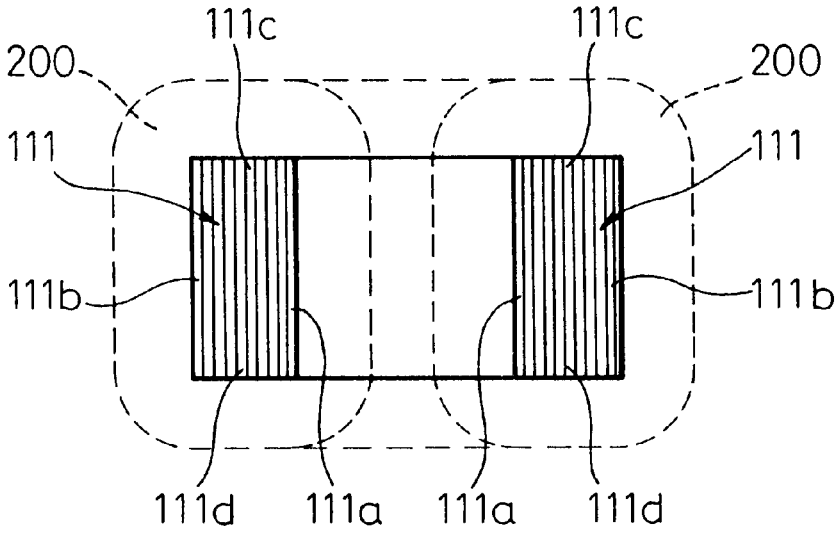
Fig.1B (PRIOR ART)
FIG. 1B is a cross-sectional diagram showing the wound core cut along a line 1B—1B shown in FIG. 1A.

FIG. 1A shows a plan view of an example of a wound core for a toroidal transformer according to the prior art, and FIG. 1B shows a cross-section of the the wound core cut along a line 1B—1B shown in FIG. 1A.

The wound core is made of a grain-oriented silicon steel strip and involves a starting part 111*a* of winding and an ending part 111*b* of winding. The wound core also involves an upper part 111*c* and a lower part 111*d*. The wound core has a toroidal winding (toroidal coil) 200.

Figure 6A:
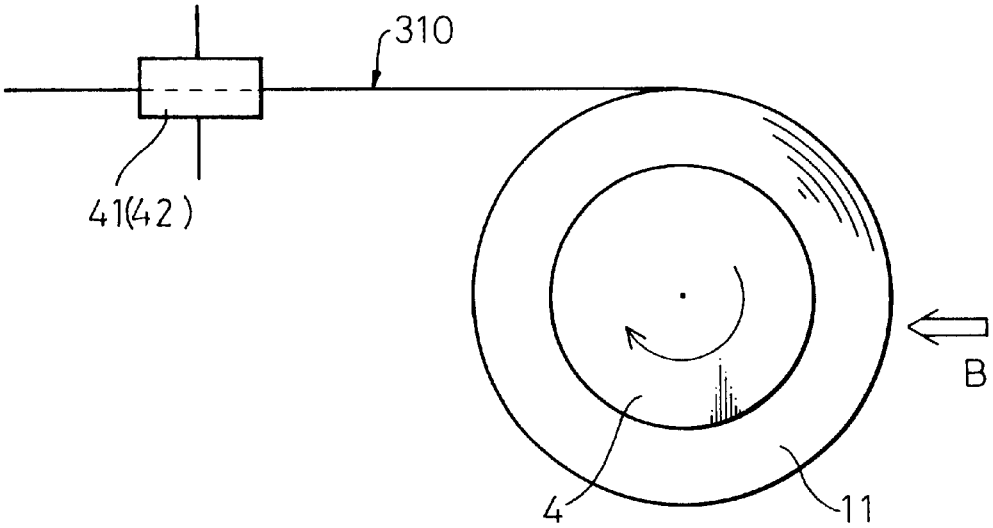
FIG. 6A is a diagram schematically showing a state of winding a shaped band around a jig to form a wound core for a toroidal transformer according to the present invention.
Figure 6B:
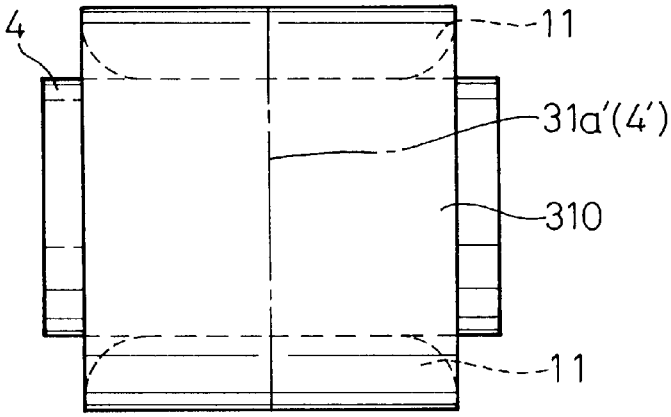
FIG. 6B is a diagram for explaining a winding process to form the wound of FIG. 6A.

The wound core 111 is made by winding several hundred turns of a grain-oriented silicon steel strip, about 0.2 to 0.3 mm thick, around a cylindrical jig (with reference to FIGS. 6A and 6B). The wound core 111 has a rectangular section with long longitudinal sides and an annular plan shape, as shown in FIGS. 1A and 1B. The surface of the wound core 111 is covered with an insulating film around which a copper wire such as an enameled wire 200 is wound according to a toroidal winding technique, to form the transformer.

An ideal sectional shape of a core of a winding is a circle. Many patent and utility model applications have disclosed wound cores having a circular section. For example, there are Japanese Patent Publication (Kokoku) Nos. 60-28375, 61-22851, and 5-29289. Note that, JPP'289 corresponds to U.S. Pat. Nos. 5,115,703 and 5,188,305.

These disclosures employ a cylindrical coil bobbin for winding a wire (coil) as nearly circular as possible.

The core for a toroidal transformer must be longitudinally elongated in section, to reduce the area occupied by the transformer. The diameter of the core must be small to reduce its weight. A core having a rectangular section has a high ratio of iron and copper to the volume of the transformer. Accordingly, the ratio of long side to short side in section of the core is preferably 1:0.9 to 0.3. This is the reason why conventional toroidal transformers employ wound cores having a rectangular section such as one shown in FIGS. 1A and 1B. Molded cores such as ferrite cores that are freely shaped according to molds are out of the scope of the present invention.

Figure 2:
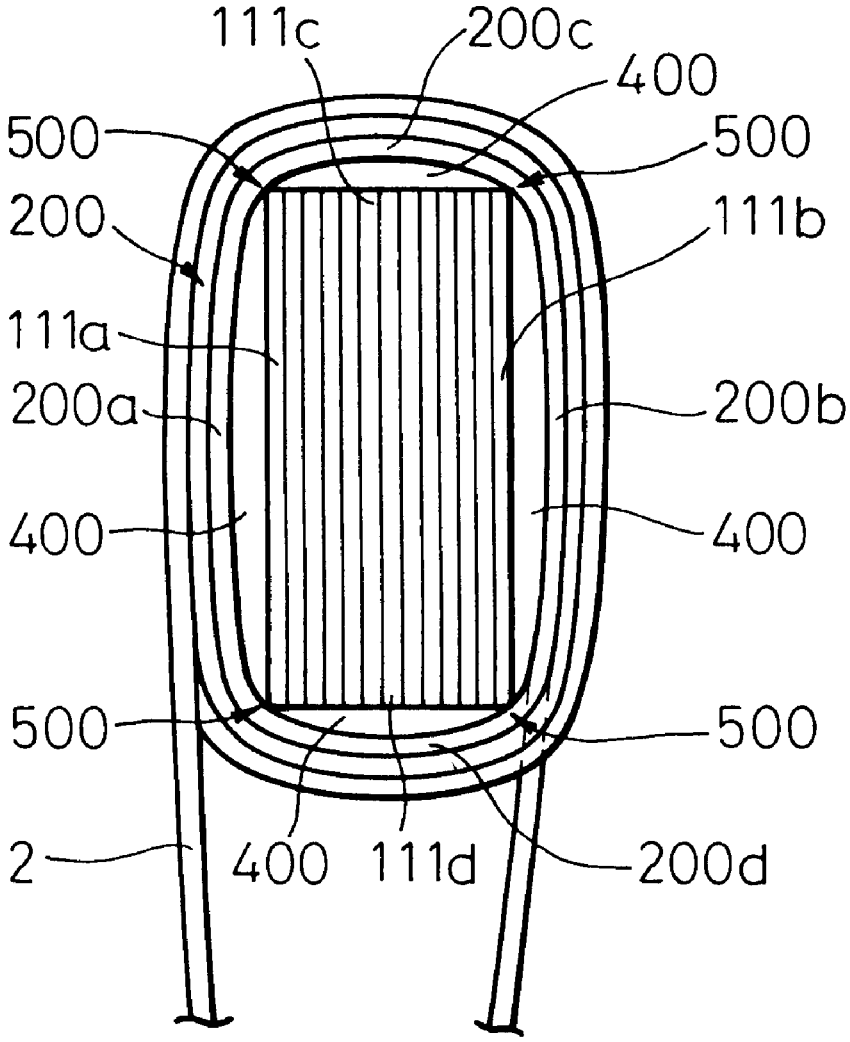
Fig. 2 (PRIOR ART)
FIG. 2 is a diagram showing a part of the wound core of FIG. 1B with a toroidal winding.

FIG. 2 shows a part of the wound core of FIG. 1B with a toroidal winding. Note that the sectional view of the wound core 111 of FIG. 2 corresponds to the right side of the wound core 111 of FIG. 1B.

In FIG. 2, the section of the wound core 111 for the toroidal transformer is rectangular. A copper wire 2 is wound around the wound core 111 according to a toroidal winding technique, to form the toroidal coil 200. Spaces 400 are formed between the inner side (starting part) 111*a* of the wound core 111 and an innermost part 200*a* of the inner side of the coil 200, between the outside (ending part) 111*b* of the wound core 111 and an innermost part 200*b* of the outer side of the coil 200, between an upper part 111*c* of the wound core 111 and an innermost part 200*c* of the top of the coil 200, and between a lower part 111*d* of the wound core 111 and an innermost part 200*d* of the bottom of the coil 200.

The spaces 400 between the wound core 111 and the coil 200 increase the size of the coil 200 and elongate the length of the copper wire per turn around the wound core 111, to increase the resistance of the coil. In addition, the spaces 400 may cause noise and vibration.

In FIG. 2, the toroidal coil 200 is in contact with corners 500 of the wound core 111 and is bent at the corners. The wire 2 (coil 200) is forcibly attached to the wound core 111 by pulling the wire 2. At this time, the excessive stress applied to the wire 2 at the corners may damage an enamel coat of the wire 2 and cause strain in the wire 2. The strain increases the natural resistance of copper, to increase the resistance of the coil and to reduce the quality of the sound from audio equipment that uses the toroidal transformer.

In the manufacturing of toroidal transformers, the coil winding is very important. An irregularly wound coil involves uneven winding density to cause a flux leakage. Accordingly, the coil winding work takes a long time. This problem is said to be unavoidable in manufacturing conventional toroidal transformers.

The trouble may be solved if the corners of a wound core for the toroidal transformer are removed.

It takes a long time, however, to cut or grind the corners of a wound core, having a rectangular section, using a lathe, etc. The removed work wears cutting blades, deforms the wound core, and produces burrs on the wound core, thereby deteriorating the properties of the wound core. The deteriorated wound core cannot be restored to a sound state even by an annealing process. The burrs will break the insulation between the layers of the wound core and short-circuit the layers, to drastically increase the iron loss. Cutting the corners is equal to a loss of material and money.

Below, embodiments of a wound core for a toroidal transformer according to the present invention will be explained with reference to accompanying drawings.

Figure 3A:
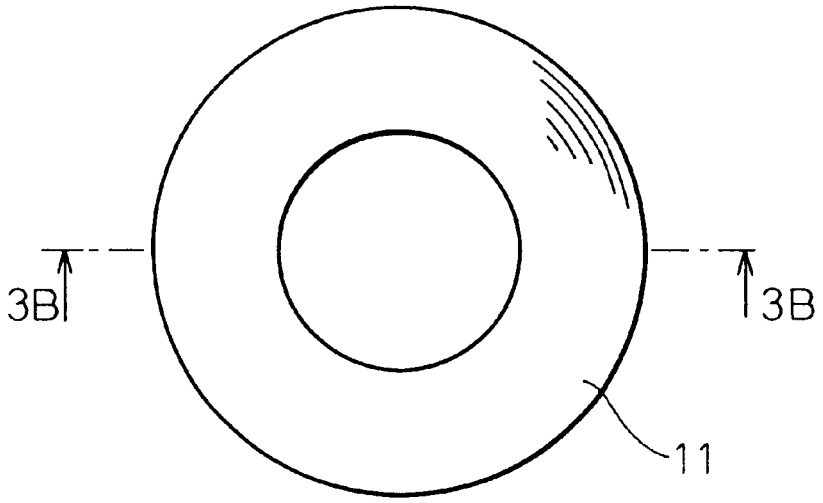
FIG. 3A is a plan diagram showing a first embodiment of a wound core for a toroidal transformer according to the present invention.
Figure 3B:
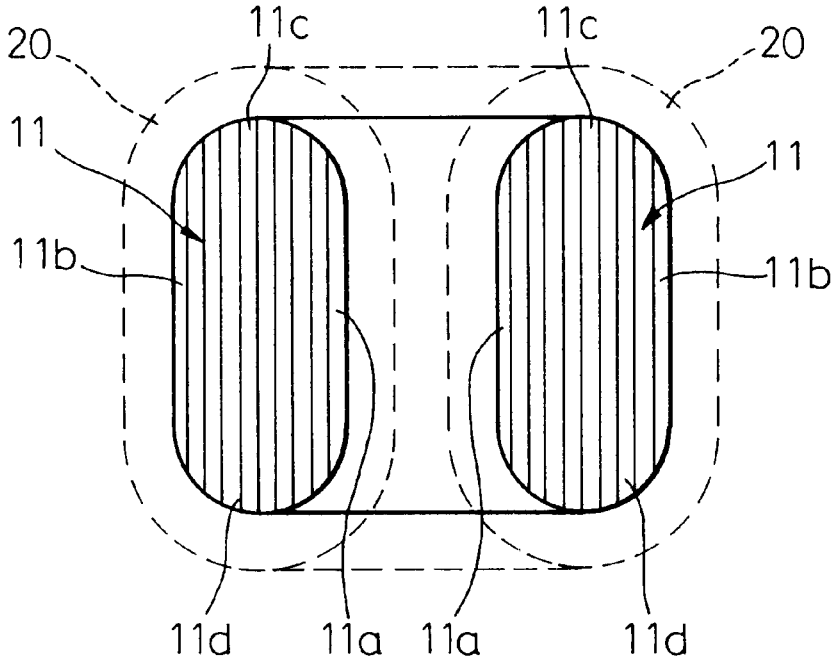
FIG. 3B is a cross-sectional diagram showing the wound core cut along a line 3B—3B shown in FIG. 3A.

FIG. 3A shows a plan view of a first embodiment of a wound core 11 for a toroidal transformer (plan view) according to the present invention, and FIG. 3B shows a cross-section of the wound core cut along a line 3B—3B shown in FIG. 3A.

Figure 5A:
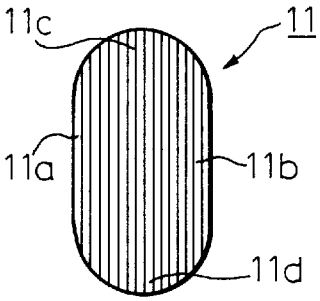
FIG. 5A is a cross-sectional diagram schematically showing the wound core of the first embodiment shown in FIGS. 3A to 4.
Figure 5B:
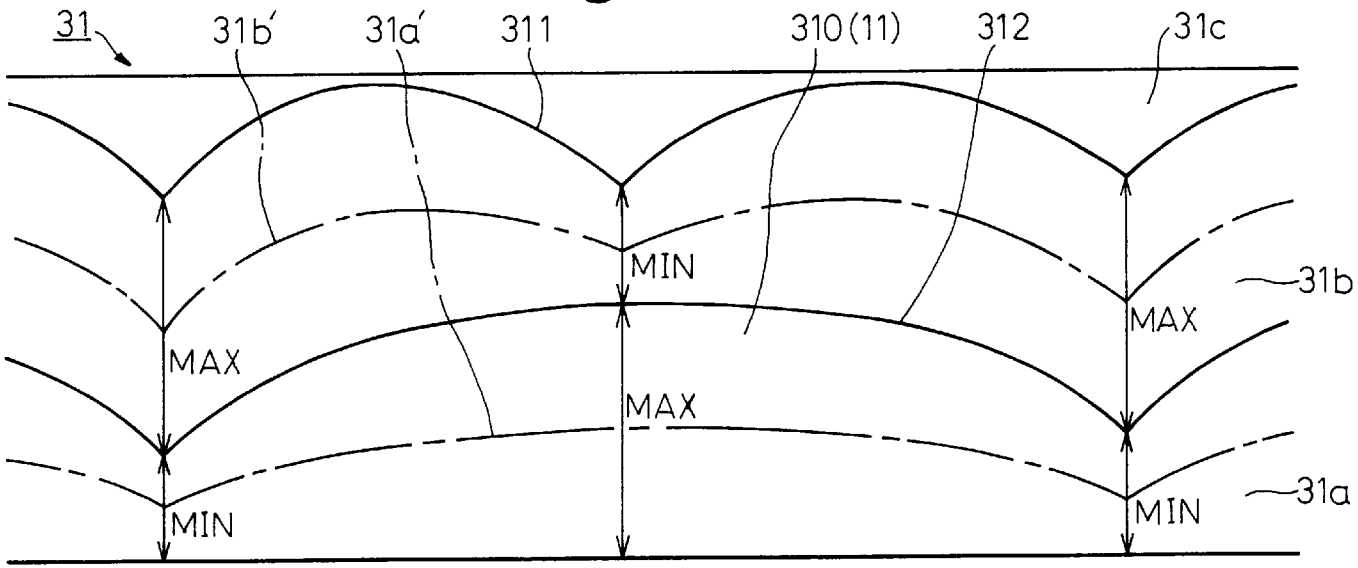
FIG. 5B is a diagram showing an example of a material strip having patterns to cut the material strip into shaped bands to form a plurality of wound cores of FIG. 5A.

The wound core 11 is made of a material strip (with reference to FIG. 5B). The wound core 11 has a starting part 11*a* of winding, an ending part 11*b* of winding, an upper part 11*c,* and a lower part 11*d.* A toroidal winding (toroidal coil) 20 is formed around the wound core 11.

The wound core 11 is made by winding several hundred turns of a grain-oriented silicon steel strip, for example, 0.2 to 0.3 mm thick, around a cylindrical jig (FIGS. 6A and 6B). The wound core 11 has semicircular longitudinal ends 11*c* and 11*d* in section. Namely, the present invention shapes the top 111*c* (11*c*) and bottom 111*d* (11*d*) of the conventional wound core 111 (11) each into a semicircle in section. The sectional shape of each of the starting and ending parts 11*a* and 11*b* of the wound core 11 is curved in accordance with the semicircular upper and lower parts 11*c* and 11*d.* The other parts of the wound core 11 are linear, similar to the conventional wound core 111 of FIG. 1B).

The wound core 11 of the first embodiment has an annular plan view as shown in FIG. 3A. The surface of the wound core 11 is covered with an insulation film around which a copper wire such as an enameled wire 2 is wound according to a toroidal winding technique, to form the toroidal transformer.

Figure 4:
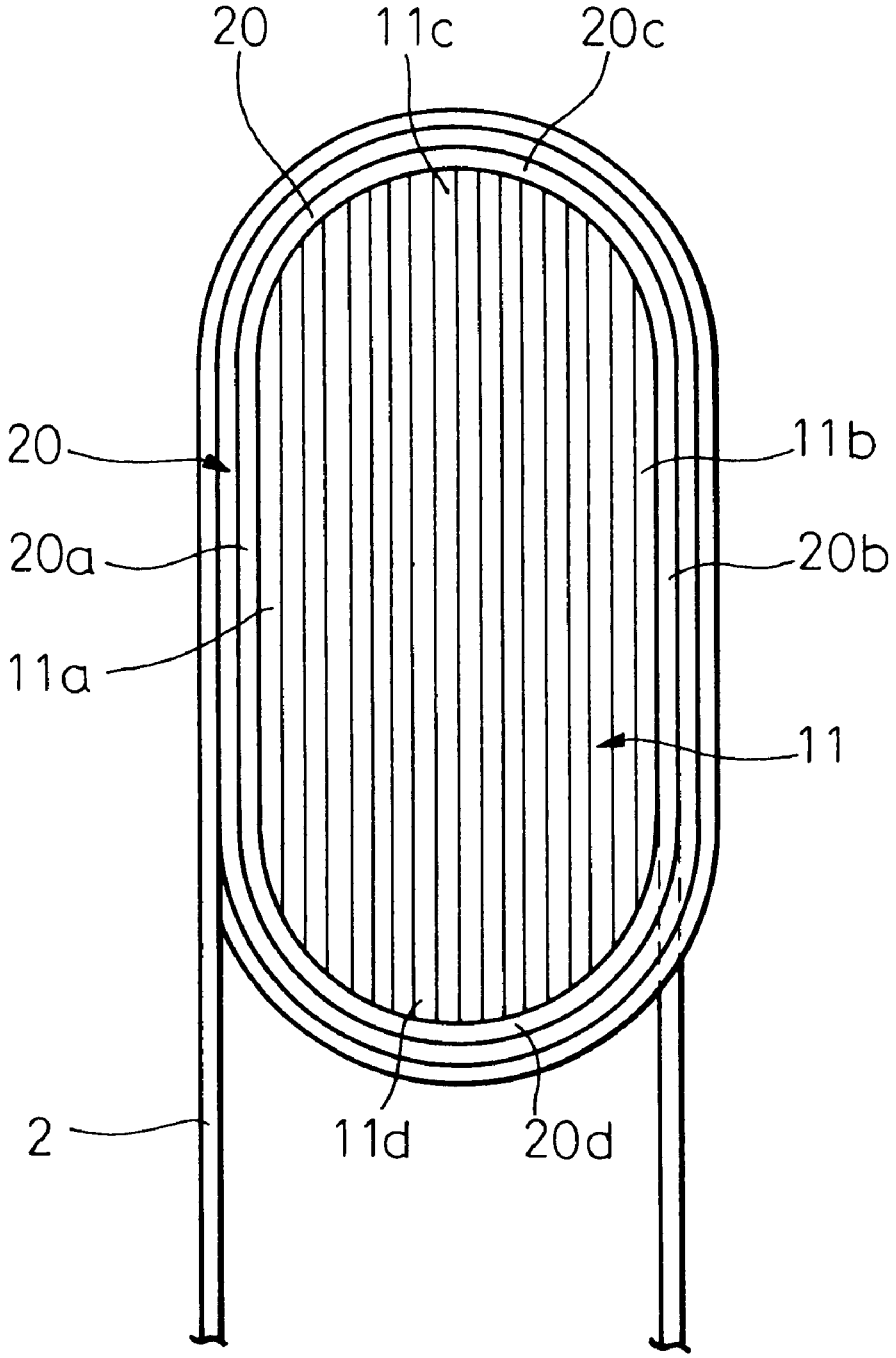
FIG. 4 is a diagram showing a part of the wound core of FIG. 3B with a toroidal winding.

FIG. 4 shows a part of the wound core 11 of FIG. 3B with a toroidal coil 20. Note that, the wound core 11 of FIG. 4 corresponds to the right side of the wound core 11 of FIG. 3B.

Referring to FIG. 4, the wound core 11 has the semicircular longitudinal ends 11*c* and 11*d* in section. Once the copper wire 2 is wound around the wound core 11 according to the toroidal winding technique into the toroidal coil 20, there are no spaces between the starting part 11*a* on the inner side of the wound core 11 and an innermost part 20*a* of the coil 20, and between the ending part 11*b* on the outer side of the wound core 11 and an innermost part 20*b* of the coil 20. Also, there are no spaces between the upper part lic of the wound core 11 and an innermost part 20*c* of the upper part of the coil 20, and between the lower part 11*d* of the wound core 11 and an innermost part 20*d* of the lower part of the coil 20. Namely, this embodiment never forms the spaces 400 of FIG. 2.

As a result, the coil 20 will never expand, and the size of the coil 20 is minimized. The length of the coil per turn around the wound core 11 is minimized to suppress the resistance of the winding. Since the wound core 11 is in tight contact with the coil 20, no noise nor vibration will occur.

The present invention also solves the problems at the corners 500 of the conventional wound core 111 of FIG. 2. The first embodiment does not require that the coil 20 be pulled to forcibly attach the coil 20 to the wound core. Accordingly, the enamel coat of the copper wire 2 will not peel off, or the copper wire will not suffer internal strain to increase the resistance thereof. As a result, the toroidal transformer achieves full performance, and audio equipment that employs the toroidal transformer provides the expected sound quality.

In this way, the wound core according to the first embodiment of the present invention solves the intrinsic problems of conventional toroidal transformers. Namely, the wound core of the first embodiment enables a coil to be neatly formed around the core, to realize uniform winding density, prevent a flux leakage, and shorten a winding time. The first embodiment improves the productivity of toroidal transformers.

FIG. 5A schematically shows a cross-section of the wound core of the first embodiment shown in FIGS. 3A to 4, and FIG. 5B shows an example of a material strip having patterns to cut the material strip into shaped bands to form a plurality of wound cores of FIG. 5A. Note that, the wound core 11 of FIG. 5A corresponds to the wound core 11 of FIGS. 3B and 4. The material strip of FIG. 5B is longitudinally scaled down by about 1/200. The same scaling down takes place also in FIGS. 7B, 8B, 9B, and 10B.

Referring to FIG. 5B, the material strip 31 is continuously cut along two cut lines 311 and 312 into shaped bands 31*a* and 31*b.* The wound core 11 of FIG. 5A of the first embodiment is formed by winding a predetermined unit length 310 of the shaped band 31*a* several hundred times around a jig 4 to be explained later. The jig 4 continuously forms wound cores, to improve the productivity of toroidal transformers.

A plurality (two in FIG. 5B) of the shaped bands 31*a* and 31*b* are cut out of the material strip 31 such that the maximum and minimum widths MAX and MIN of the shaped band 31*a* are adjacent to the minimum and maximum widths MIN and MAX of the other band 31*b.* This arrangement improves the efficiency of use of the material strip 31. Namely, this reduces the quantity of a remainder 31*c* which must be discarded after the shaped bands 31*a* and 31*b* are cut out of the material strip 31. According to the first embodiment, only one part 31*c* is discarded.

In FIG. 5B, the shaped bands 31*a* and 31*b* are cut out of the material strip 31 such that a linear edge of the material strip 31 is used as it is as a linear edge of the shaped band 31*a.* This reduces the number of cut lines on the material strip 31. According to the embodiment of FIG. 5B, the two shaped bands 31*a* and 31*b* are cut along the two cut lines 311 and 312.

According to the first embodiment as well as the second to fifth embodiments, one or two shaped bands 31*a* and 31*b* (32*a,* 32*b;* 33*a,* 33*b;* 34*a;* 35*a*) are cut out of one material strip 31 (32; 33; 34; 35). It is possible to cut many (three, four, five, and so on) shaped bands out of a single material strip.

FIG. 6A schematically shows a state of winding a shaped band around a jig to form a wound core for a toroidal transformer according to the present invention, and FIG. 6B is a diagram for explaining a winding process to form the wound core of FIG. 6A. Note that, FIG. 6A is a front view and FIG. 6B is a side view seen from a reference mark B of FIG. 6A.

In FIGS. 6A and 6B, a predetermined unit length 310 of the shaped band 31*a* of FIG. 5B is wound around the cylindrical jig 4, to form the wound core 11 for a toroidal transformer. The jig 4 is turned around an axis thereof, and centering guide rollers 41 (42) align the longitudinal center line 31*a*' of the shaped band 31*a* with the widthwise center 4' of the jig 4. Accordingly, even if the shaped band 31*a* or 31*b* is curved, it is correctly wound around the jig 4, to form the wound core 11 having the symmetrical upper and lower parts 11*c* and 11*d* with respect to the center line 31*a*' (4'). Each side-edge of the shaped band 31*a* (310) is supported by the guide rollers 41 and 42, so that the center line 31*a*' of the shaped band 31*a* aligns with the center 4' of the jig 4.

The process of winding the shaped band 31*a* (310) around the jig 4 of FIGS. 6A and 6B is applied to the second to fifth embodiments to be explained below. In FIG. 6B, the width of the jig 4 is longer than the maximum width MAX of the shaped band 31*a* (310). The width of the jig 4 may be equal to or shorter than the maximum width of a band to be wound.

Figure 7A:
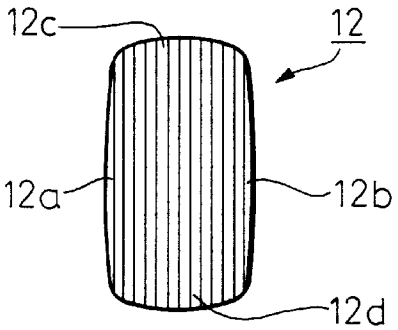
FIG. 7A is a cross-sectional diagram schematically showing a second embodiment of a wound core for a toroidal transformer according to the present invention.
Figure 7B:
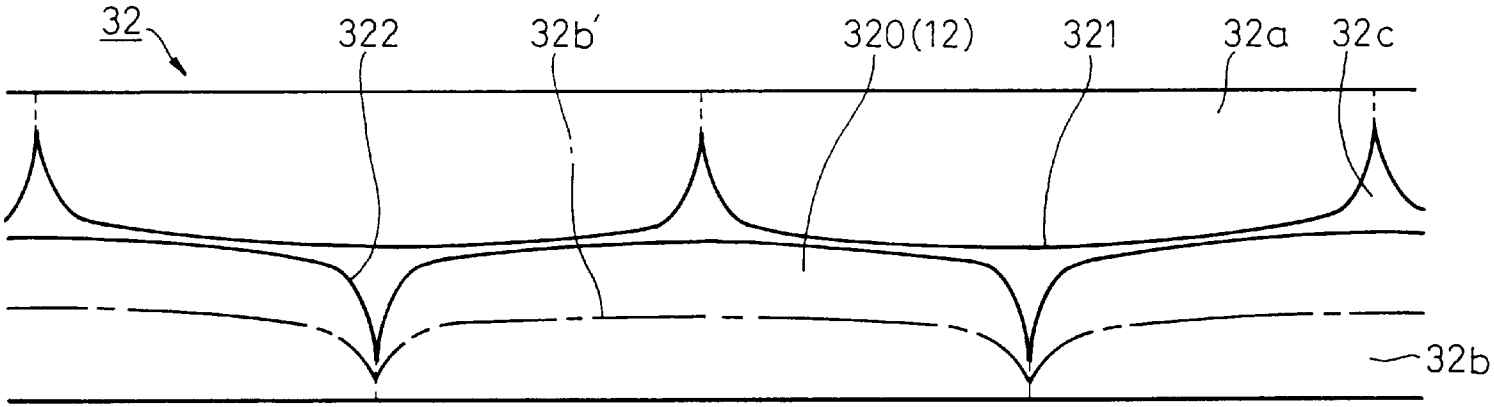
FIG. 7B is a diagram showing an example of a material strip having patterns to cut the material strip into shaped bands to form a plurality of wound cores of FIG. 7A.

FIG. 7A schematically shows a cross-section of the wound core of a second embodiment of the present invention, and FIG. 7B shows an example of a material strip having patterns to cut the material strip into shaped bands to form a plurality of wound cores of FIG. 7A.

In FIG. 7A, the wound core 12 of the second embodiment has elliptic longitudinal ends 12*c* and 12*d* in section. A starting part 12*a* of winding and an ending part 12*b* of winding of the wound core 12 are elliptic. This configuration improves the attachment of a coil 20 to the wound core 12, thereby minimizing the size of the coil 20, suppressing the resistance of the coil, and preventing noise and vibration. It is not necessary to forcibly attach the coil 20 to the wound core 12, so that an enamel coat of the coil is not damaged, and a copper wire of the coil suffer no internal strain that may increase the resistance thereof.

In FIG. 7B, a material strip 32 is continuously cut along two cut lines 321 and 322, to form two shaped bands 32*a* and 32*b*. The wound core 12 is formed by aligning the center line 32*b*' of the shaped band 32*b* with the center 4' of the jig 4 (FIGS. 6A and 6B) and by winding each unit length 320 of the shaped band 32*b* around the jig 4.

A plurality (two in FIG. 7B) of the shaped bands 32*a* and 32*b* are cut out of the material strip 32 such that the widest and narrowest portions of the band 32*a* are adjacent to the narrowest and widest portions of the shaped band 32*b*. A remainder 32*c*, between the shaped bands 32*a* and 32*b* of the material strip 32, is discarded. This configuration improves the efficiency of use of the material strip. Namely, the quantity of the portion 32*c* to be discarded after the shaped bands 32*a* and 32*b* are cut out of the material strip 32 is decreased. According to the second embodiment, only one strip 32*c* must be discarded.

In FIG. 7B, the material strip 32 is cut such that each linear side-edge of the material strip 32 is used as one of the side-edges of each of the shaped bands 32*a* and 32*b*. This decreases the number of cut lines on the material strip 32. According to the embodiment of FIG. 7B, the two cut lines 321 and 322 are sufficient to cut the two shaped bands 32*a* and 32*b*.

Figure 8A:
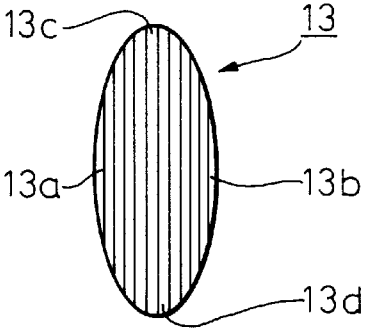
FIG. 8A is a cross-sectional diagram schematically showing a third embodiment of a wound core for a toroidal transformer according to the present invention.
Figure 8B:
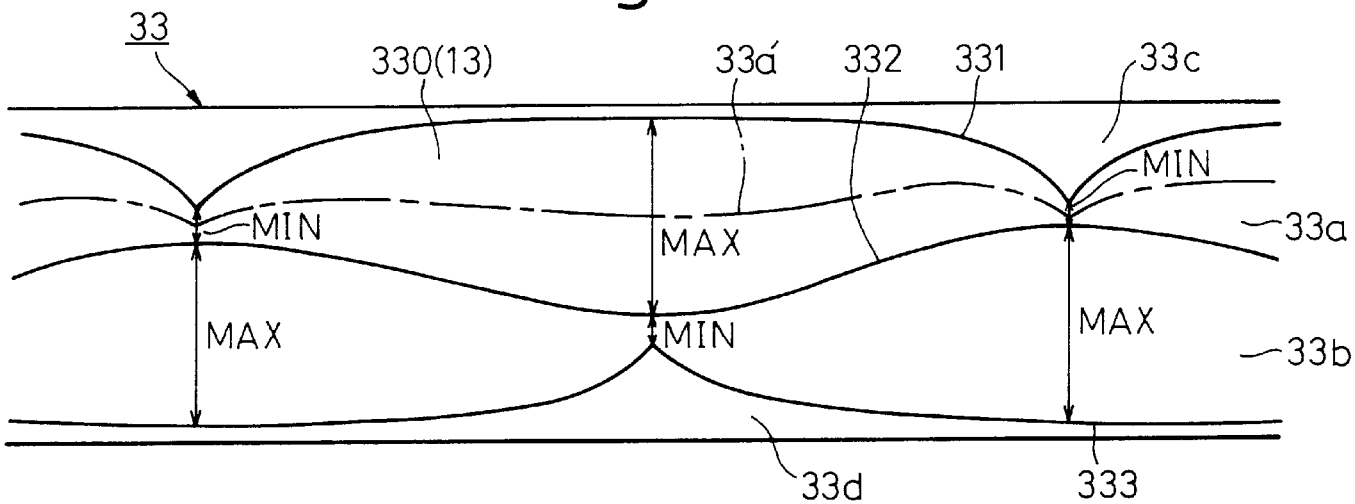
FIG. 8B is a diagram showing an example of a material strip having patterns to cut the material strip into shaped bands to form a plurality of wound cores of FIG. 8A.

FIG. 8A schematically shows a cross-section of the wound core of a third embodiment of the present invention, and FIG. 8B shows an example of a material strip having patterns to cut the material strip into shaped bands to form a plurality of wound cores of FIG. 8A.

In FIG. 8A, the wound core 13 of the third embodiment has an elliptic section. Namely, the wound core 13 has elliptic longitudinal ends 13*c* and 13*d*. A starting part 13*a* of winding and an ending part 13*b* of winding of the wound core 13 are also elliptic in section. This configuration further improves the attachment a coil 20 to the wound core 13, thereby minimizing the size of the coil 20, suppressing the resistance of the coil, and preventing noise or vibration. The coil 20 is never forcibly attached to the wound core 13, so that the enamel coat of the coil 20 is not broken, nor does the copper wire of the coil suffer internal strain that may increase the resistance thereof.

In FIG. 8B, a material strip 33 is continuously cut along three cut lines 331, 332, and 333 into two shaped bands 33*a* and 33*b*. The wound core 13 is formed by winding a predetermined unit length 330 of the shaped band 33*a* around the jig 4 (FIGS. 6A and 6B) while aligning the center line 33*a*' of the shaped band 33*a* with the center 4' of the jig 4.

A plurality (two in FIG. 8B) of the shaped bands 33*a* and 33*b* are cut out of the material strip 33 such that the maximum and minimum widths MAX and MIN of the shaped band 33*a* are adjacent to the minimum and maximum widths MIN and MAX of the other shaped band 33*b*. This configuration improves the efficiency of use of the material strip 33. Namely, the remainders 33*c* and 33*d*, to be discarded after the shaped bands 33*a* and 33*b* are cut out of the material strip 33, are minimized. According to the third embodiment, there are two remainders 31*c* and 31*d* to be discarded. If the material strip 33 has defects on each edge, the defects may be positioned in the parts 31*c* and 31*d* to be discarded. Namely, the shaped bands 33*a* and 33*b* will not involve the defects, to maintain the quality of the wound core 13.

Figure 9A:
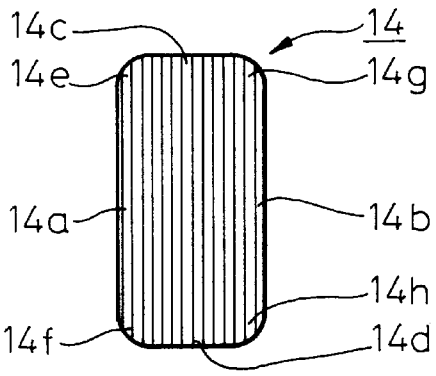
FIG. 9A is a cross-sectional diagram schematically showing a fourth embodiment of a wound core for a toroidal transformer according to the present invention.
Figure 9B:
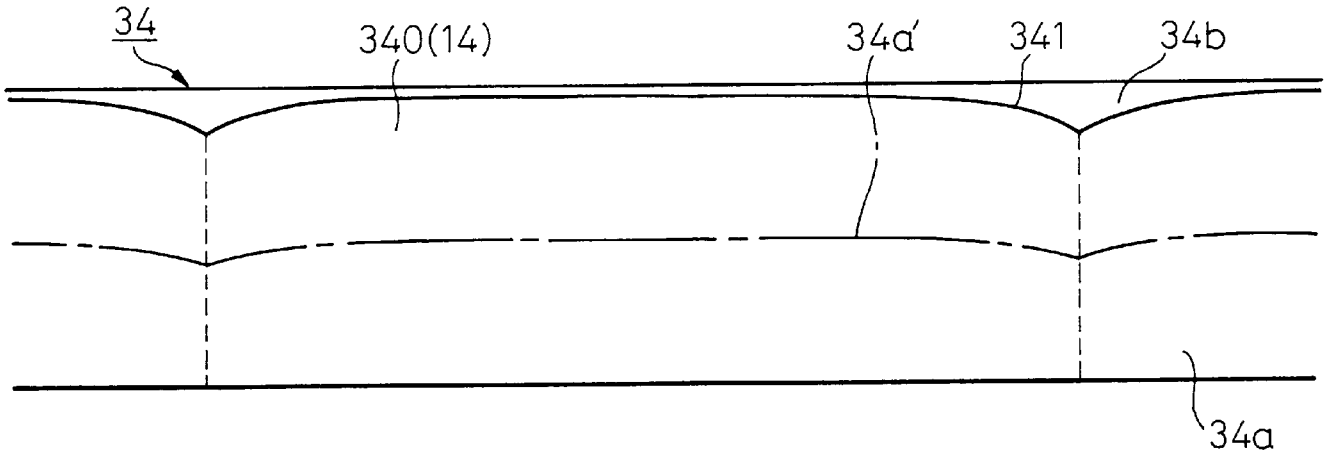
FIG. 9B is a diagram showing an example of a material strip having patterns to cut the material strip into shaped bands to form a plurality of wound cores of FIG. 9A.

FIG. 9A schematically shows a cross-section of the wound core of a fourth embodiment of the present invention, and FIG. 9B shows an example of a material strip having patterns to cut the material strip into shaped bands to form a plurality of wound cores of FIG. 9A.

In FIG. 9A, the wound core 14 according to the fourth embodiment has curved corners 14*e*, 14*f*, 14*g*, 14*h* in section. This configuration improves the attachment of a coil 20 to the wound core 13 further than the prior art of FIGS. 1A to 2, thereby minimizing the size of the coil 20, suppressing the resistance of the coil, and preventing noise and vibration. It is not necessary to forcibly attach the coil 20 to the wound core 13, so that the enamel coat of the coil 20 is not damaged, or a copper wire of the coil suffer no internal strain that may increase the resistance thereof.

In FIG. 9B, the material strip 34 is continuously cut along a cut line 341 into a shaped band 34*a*. The wound core 14 is formed by winding a predetermined unit length 340 of the shaped band 34*a* around the jig 4 (FIGS. 6A and 6B) with the center line 34*a*' of the shaped band 34*a* being aligned with the center 4' of the jig 4.

The fourth embodiment cuts the shaped band 34*a* out of the material strip 34 such that a linear side-edge of the material strip 34 is left as it is as a linear side-edge of the shaped band 34*a*. This results in reducing the number of cut lines on the material strip 34. According to the embodiment of FIG. 9B, the single cut line 341 is sufficient to cut the shaped band 34*a* out of the material strip 34.

Figure 10A:
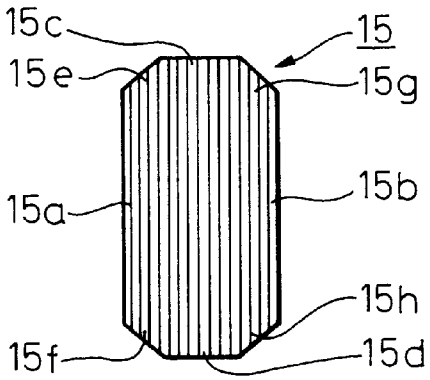
FIG. 10A is a cross-sectional diagram schematically showing a fifth embodiment of a wound core for a toroidal transformer according to the present invention.
Figure 10B:
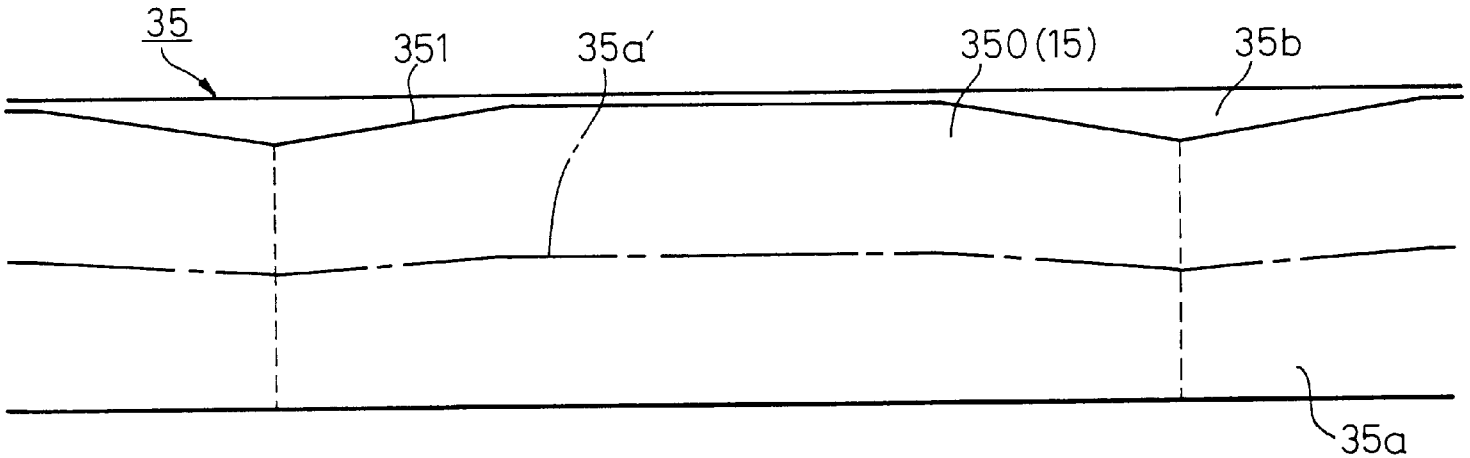
FIG. 10B is a diagram showing an example of a material strip having patterns to cut the material strip into shaped bands to form a plurality of wound cores of FIG. 10A.

FIG. 10A schematically shows a cross-section of the wound core of a fifth embodiment of the present invention, and FIG. 10B shows an example of a material strip having patterns to cut the material strip into shaped bands to form a plurality of wound cores of FIG. 10A.

In FIG. 10A, the wound core 15 of the fifth embodiment has linearly beveled corners 15*e*, 15*f*, 15*g*, and 15*h* in section. Namely, the wound core 15 of the fifth embodiment has polygonal longitudinal ends 15*c* and 15*d* in section. A starting part 15*a* of winding and an ending part 15*b* of winding of the wound core 15 are also polygonal in section.

The sectional shape of the wound core of this embodiment may be hexagonal, octagonal, dodecagonal, or any other suitable shape.

The attachment of a coil (toroidal coil) 20 to the wound core 15 is improved further than the prior art of FIGS. 1A to 2, thereby minimizing the size of the coil 20, suppressing the resistance of the coil, and preventing noise and vibration. It is not necessary to forcibly attach the coil 20 to the wound core 15, so that an enamel coat of the coil is not damaged, and a copper wire of the coil does not suffer internal strain that may increase the resistance thereof. The fifth embodiment is suitable when the coil 20 must not be attached to the wound core too tightly, in order to reduce the electrostatic capacitance between the wound core and the coil, and at the same time, to solve the problems of the conventional wound core having a rectangular section.

In FIG. 10B, a material strip 35 is continuously cut along a cut line 351 into a shaped band 35*a*. The wound core 15 of the fifth embodiment of FIG. 10A is produced by winding a predetermined unit length 350 of the shaped band 35*a* around the jig 4 (FIGS. 6A and 6B) with the center line 35*a*' of the band 35*a* being aligned with the center 4' of the jig 4.

The fifth embodiment uses a linear side-edge of the material strip 35 as it is as a linear side-edge of the shaped band 35*a*. This reduces the number of cut lines on the material strip 35. According to the embodiment of FIG. 10B, the single cut line 351 is sufficient to cut the shaped band 35*a* from the material strip.

This embodiment properly fits a copper wire of the coil around the wound core without applying excessive stress to the copper wire, thereby preventing distortion of the copper wire, shortening the length of the copper wire per turn, and neatly arranging the coil to improve the space factor. This embodiment is effective in solving the problems of the conventional wound core having a rectangular section, making the winding work easier, improving the productivity of wound cores, and allowing the toroidal transformer that employs this wound core to achieve full performance.

As explained above in detail, a wound core according to the present invention has an improved shape to properly attach a coil to the wound core. This wound core allows a toroidal transformer that employs the wound core achieve to full performance, and improves the productivity of the toroidal transformers.

Many different embodiments of the present invention may be constructed without departing from the spirit and scope of the present invention, and it should be understood that the present invention is not limited to the specific embodiments described in this specification, except as defined in the appended claims.

What is claimed is:

1. A toroidal transformer, having a shape defining a circular outer circumference and a circular inner circumference, comprising:

a wound core having a shape defining a circular outer circumference and a circular inner circumference, formed from a single shaped band cut from a material strip, the wound core having a longitudinally-elongated cross sectional shape that is free from rectangular corners and has semi-circular end portions, the cross sectional shape being elongated in an axial direction with respect to the wound core, a ratio of a length of long side to a length of short side of said longitudinally elongated shape being in the range of 1:0.9 to 1:0.3; and a toroidal winding wound on the wound core around the circular outer and inner circumference of the wound core without an intervening bobbin.

2. A toroidal transformer, having a shape defining a circular outer circumference and a circular inner circumference, comprising:

a wound core having a shape defining a circular outer circumference and a circular inner circumference, formed from a single shaped band cut from a material strip, the wound core having a longitudinally-elongated cross section shape that is free from rectangular corners and has semi-elliptical end portions, the cross sectional shape being elongated in an axial direction with respect to the wound core, a ratio of a length of long side to a length of short side of said longitudinally elongated shape being in the range of 1:0.9 to 1:0.3; and a toroidal winding wound on the wound core around the circular outer and inner circumference of the wound core without an intervening bobbin.

3. A toroidal transformer, having a shape defining a circular outer circumference and a circular inner circumference, comprising:

a wound core having a shape defining a circular outer circumference and a circular inner circumference, formed from a single shaped band cut from a material strip, the wound core having a longitudinally-elongated elliptical cross-sectional shape, the cross sectional shape being elongated in an axial direction with respect to the wound core, a ratio of a length of long side to a length of short side of said longitudinally elongated shape being in the range of 1:0.9 to 1:0.3; and a toroidal winding wound on the wound core around the circular outer and inner circumference of the wound core without an intervening bobbin.

* * * * *

UNITED STATES PATENT AND TRADEMARK OFFICE

CERTIFICATE OF CORRECTION

PATENT NO. : 6,407,655 B1
DATED : June 18, 2002
INVENTOR(S) : Kitamura

It is certified that error appears in the above-identified patent and that said Letters Patent is hereby corrected as shown below:

Column 10, after line 49, please insert the following omitted claims:

-- 4. A toroidal transformer as claimed in claim 1, further comprising an insulating film on a surface of the wound core, between the wound core and the toroidal winding.

5. A toroidal transformer as claimed in claim 2, further comprising an insulating film on a surface of the wound core, between the wound core and the toroidal winding.

6. A toroidal transformer as claimed in claim 3, further comprising an insulating film on a surface of the wound core, between the wound core and the toroidal winding. --

Signed and Sealed this

First Day of April, 2003

JAMES E. ROGAN
*Director of the United States Patent and Trademark Office*